US008994770B2

(12) United States Patent
Chen

(10) Patent No.: US 8,994,770 B2
(45) Date of Patent: Mar. 31, 2015

(54) OPTICAL SCANNING SYSTEM FOR USE IN AN IMAGING APPARATUS

(71) Applicant: Lexmark International, Inc., Lexington, KY (US)

(72) Inventor: Fei Chen, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 13/902,170

(22) Filed: May 24, 2013

(65) Prior Publication Data

US 2014/0267537 A1 Sep. 18, 2014

Related U.S. Application Data

(60) Provisional application No. 61/792,288, filed on Mar. 15, 2013.

(51) Int. Cl.
*B41J 15/14* (2006.01)
*B41J 27/00* (2006.01)
*G03G 15/01* (2006.01)

(52) U.S. Cl.
CPC ..... *G03G 15/011* (2013.01)
USPC ..... 347/244; 347/258

(58) Field of Classification Search
USPC ..... 347/230–233, 241–244, 256–261; 359/203.1, 204.1, 206.1–207.6, 215.1, 359/216.1
See application file for complete search history.

(56) References Cited

U.S. PATENT DOCUMENTS

| | | | | |
|---|---|---|---|---|
| 5,255,115 | A * | 10/1993 | Kikuchi | 359/209.1 |
| 6,790,389 | B2 | 9/2004 | Koreeda et al. | |
| 6,813,051 | B2 * | 11/2004 | Suzuki et al. | 359/201.1 |
| 7,075,691 | B2 | 7/2006 | Koreeda et al. | |
| 7,161,724 | B1 * | 1/2007 | Miyatake | 359/204.1 |
| 7,380,720 | B2 | 6/2008 | Shimomura | |
| 2007/0171498 | A1 * | 7/2007 | Kurihara | 359/204 |
| 2008/0068690 | A1 * | 3/2008 | Ichii | 359/204 |
| 2013/0083148 | A1 * | 4/2013 | Miyatake et al. | 347/224 |

* cited by examiner

*Primary Examiner* — Hai C Pham

(57) ABSTRACT

A scanning unit includes a scanning member having at least one reflective surface for reflecting light incident thereon, a plurality of light sources controllable to emit light beams onto the at least one reflective surface, and first and second scan lenses for receiving and focusing the light beams reflected from the at least one reflective surface. Each of the first and second scan lenses has a light exit surface having a first curved surface section and a second curved surface section defining therebetween a junction line extending between opposed longitudinal ends of each of the first and second scan lenses. The junction line is nonlinear.

24 Claims, 6 Drawing Sheets

OPTICAL SCANNING SYSTEM FOR USE IN AN IMAGING APPARATUS

CROSS REFERENCES TO RELATED APPLICATIONS

The present application is related to and claims benefit under 35 U.S.C. 119(e) from U.S. provisional application 61/792,288, filed Mar. 15, 2013, entitled, "Optical Scanning System for Use in an Imaging Apparatus," the content of which is hereby incorporated by reference herein it is entirety.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to an optical scanning system in an imaging apparatus, and particularly to such a system utilizing a scan lens design and arrangement thereof which allow for a more compact scanning unit.

2. Description of the Related Art

In various imaging devices which utilize light to form images, optical scanning systems are typically employed to scan modulated light beams from one or more light sources onto at least one target surface on which images are to be formed. In an electrophotographic imaging device, for example, an optical scanning system typically includes a scanning mirror which reflects a modulated light beam towards a plurality of optical components. Such optical components may include lenses and mirrors which direct and focus the reflected light beam to form light spots upon a surface of a photosensitive member. As the scanning mirror moves, either in a reciprocating manner as with the case of a torsion oscillator or rotationally as with the case of a polygon mirror, the light beam reflected thereby is scanned across each of the optical components of the optical scanning system. Ultimately, the light beam impinges and is swept across the photosensitive member, which may itself be rotating, as scan lines so as to form latent images thereon.

A color laser printer, for example, may have four laser beam channels in its laser scanning unit (LSU), one for each of cyan, magenta, yellow, and black color planes. Scan lenses are used to focus the laser beams into small spot sizes on photosensitive members across all scan positions. In addition, the scan lenses keep a linear spot velocity during scanning and minimize the process and scan jitter induced by scanner mirror error. Scan lenses are complex optical components in the LSU and contribute a significant portion to the total size and cost of an LSU.

Some traditional optical designs for LSUs generally require one or two scan lenses per channel. Thus, the total quantity of scan lenses for all four channels for a color LSU may usually range from four to eight. Having such number of scan lenses may require a relatively large space requirement for the LSU. Moreover, the cost of the LSU also increases as the number of scan lenses increases.

In some existing designs, the number of scan lenses is reduced by allowing two channels to share one scan lens such that two laser beams enter the scan lens through opposite surfaces thereof. However, because two laser beams enter a single scan lens from opposite directions, the opposite lens surfaces must be symmetrical and the scan lens is typically large and thick in order to have a decent optical performance particularly on laser spot size. The cost of a plastic scan lens, for example, is mainly determined by the cycle time of the injection molding, and the cycle time is mainly determined by the thickness and size of the scan lens because a thicker lens requires much longer cooling time. As a result, the cost reduction due to the decrease in the quantity of scan lenses may be offset by increased cost per scan lens. Moreover, designs requiring two thick scan lenses may also add additional constraints on the optical layout of the LSU, such as requiring additional fold mirrors before the laser beams reach the scan lenses. This adds to the accumulated tolerances for the optical paths and makes it difficult to have precise optical alignment therein.

Accordingly, there is a need for an improved scanning unit which is more size and cost efficient.

SUMMARY

Example embodiments of the present disclosure provide a scanning system incorporating an optical design which allows for a more compact scanning unit.

In an example embodiment, a scanning system includes a scanning member having at least one reflective surface for reflecting light incident thereon. A first light source, a second light source, a third light source, and a fourth light source are controllable to emit first, second, third, and fourth light beams, respectively. Each of the first, second, third, and fourth light beams are configured to be incident on one planar surface portion of the at least one reflective surface of the scanning member at different angles with respect to a reference plane extending perpendicular to the planar surface portion such that the light beams are reflected off of the planar surface portion at different angles with respect to the reference plane. A first scan lens and a second scan lens are disposed downstream from the scanning member relative to the optical paths of the light beams. The first scan lens receives and focuses the reflected first and second light beams, and the second scan lens receives and focuses the reflected third and fourth light beams. A plurality of mirrors are disposed downstream the scanning member to direct the reflected and focused light beams to at least one surface.

In another example embodiment, each of the scan lenses has a light incident surface that is substantially planar, and a light exit surface having two curved surface sections. A first curved surface section and a second curved surface section of the light exit surface define therebetween a junction line extending between opposed longitudinal ends of the scan lens. The junction line is non-linear and, in particular, substantially bowed in a sub-scan direction perpendicular to a main scan direction extending longitudinally across the scan lens.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings, wherein.

DETAILED DESCRIPTION

Figure 1:
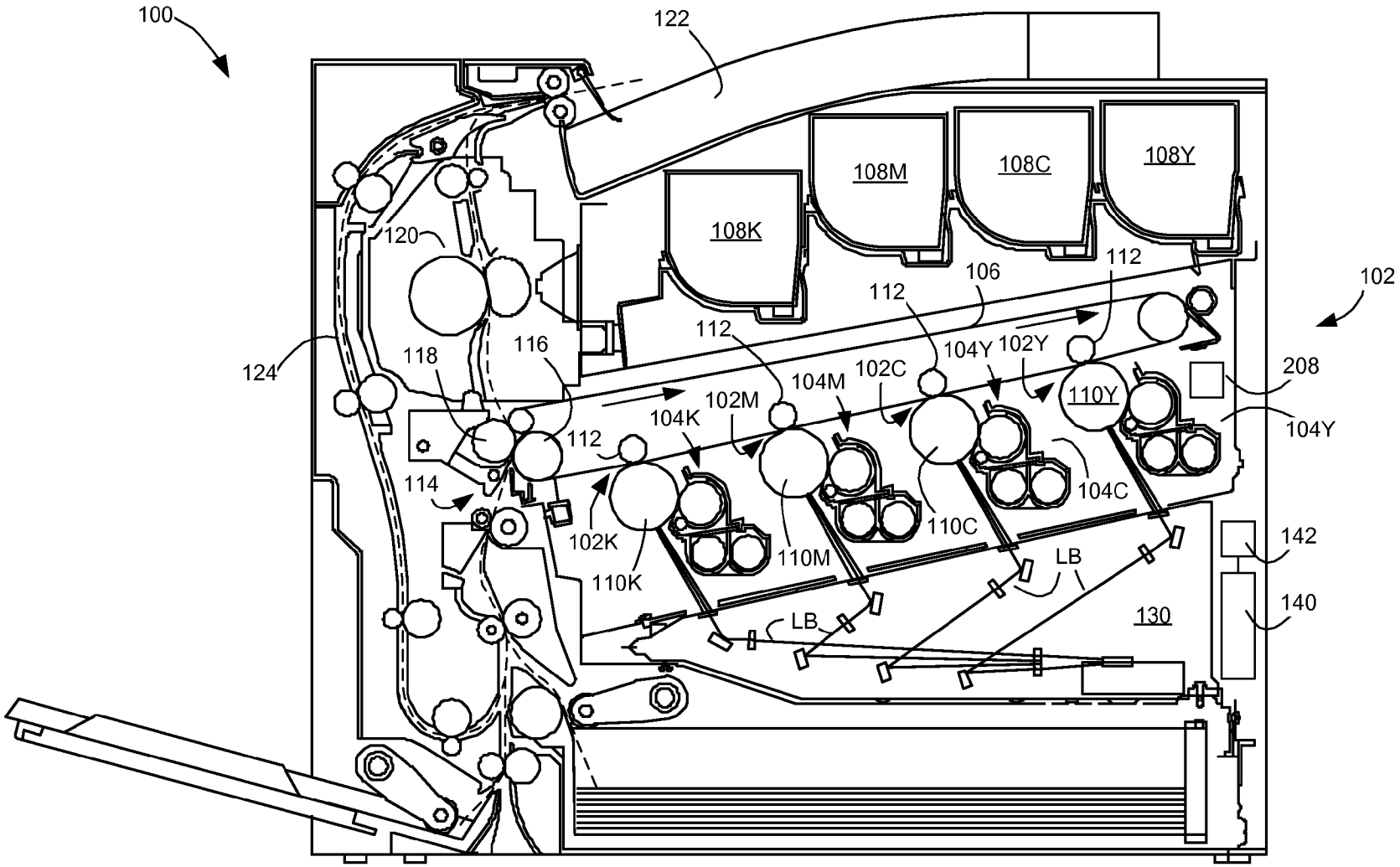
FIG. 1 is a side elevational view of an imaging device according to an example embodiment.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Spatially relative terms such as "top", "bottom", "front", "back" and "side", "above", "under", "below", "lower", "over", "upper", and the like, are used for ease of description to explain the positioning of one element relative to a second element. Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

FIG. 1 illustrates a color image forming device 100 according to an example embodiment. Image forming device 100 includes a first toner transfer area 102 having four developer units 104 that substantially extend from one end of image forming device 100 to an opposed end thereof. Developer units 104 are disposed along an intermediate transfer member (ITM) 106. Each developer unit 104 holds a different color toner. The developer units 104 may be aligned in order relative to the direction of the ITM 106 indicated by the arrows in FIG. 1, with the yellow developer unit 104Y being the most upstream, followed by cyan developer unit 104C, magenta developer unit 104M, and black developer unit 104K being the most downstream along ITM 106.

Each developer unit 104 is operably connected to a toner reservoir 108 for receiving toner for use in a printing operation. Each toner reservoir 108 is controlled to supply toner as needed to its corresponding developer unit 104. Each developer unit 104 is associated with a photoconductive member 110 that receives toner therefrom during toner development to form a toned image thereon. Each photoconductive member 110 is paired with a transfer member 112 for use in transferring toner to ITM 106 at first transfer area 102.

During color image formation, the surface of each photoconductive member 110 is charged to a specified voltage, such as −800 volts, for example. At least one laser beam LB from a printhead or laser scanning unit (LSU) 130 is directed to the surface of each photoconductive member 110 and discharges those areas it contacts to form a latent image thereon. In one embodiment, areas on the photoconductive member 110 illuminated by the laser beam LB are discharged to approximately −100 volts. The developer unit 104 then transfers toner to photoconductive member 110 to form a toner image thereon. The toner is attracted to the areas of the surface of photoconductive member 110 that are discharged by the laser beam LB from LSU 130.

ITM 106 is disposed adjacent to each of developer unit 104. In this embodiment, ITM 106 is formed as an endless belt disposed about a drive roller and other rollers. During image forming operations, ITM 106 moves past photoconductive members 110 in a clockwise direction as viewed in FIG. 1. One or more of photoconductive members 110 applies its toner image in its respective color to ITM 106. For monocolor images, a toner image is applied from a single photoconductive member 110K. For multi-color images, toner images are applied from two or more photoconductive members 110. In one embodiment, a positive voltage field formed in part by transfer member 112 attracts the toner image from the associated photoconductive member 110 to the surface of moving ITM 106.

ITM 106 rotates and collects the one or more toner images from the one or more developer units 104 and then conveys the one or more toner images to a media sheet at a second transfer area 114. Second transfer area 114 includes a second transfer nip formed between at least one back-up roller 116 and a second transfer roller 118.

Fuser assembly 120 is disposed downstream of second transfer area 114 and receives media sheets with the unfused toner images superposed thereon. In general terms, fuser assembly 120 applies heat and pressure to the media sheets in order to fuse toner thereto. After leaving fuser assembly 120, a media sheet is either deposited into output media area 122 or enters duplex media path 124 for transport to second transfer area 114 for imaging on a second surface of the media sheet.

Image forming device 100 is depicted in FIG. 1 as a color laser printer in which toner is transferred to a media sheet in a two step operation. Alternatively, image forming device 100 may be a color laser printer in which toner is transferred to a media sheet in a single step process—from photoconductive members 110 directly to a media sheet. In another alternative embodiment, image forming device 100 may be a monochrome laser printer which utilizes only a single developer unit 104 and photoconductive member 110 for depositing black toner directly to media sheets. Further, image forming device 100 may be part of a multi-function product having, among other things, an image scanner for scanning printed sheets.

Image forming device 100 further includes a controller 140 and memory 142 communicatively coupled thereto. Though not shown in FIG. 1, controller 140 may be coupled to components and modules in image forming device 100 for controlling same. For instance, controller 140 may be coupled to toner reservoirs 108, developer units 104, photoconductive members 110, fuser 120 and/or LSU 130 as well as to motors (not shown) for imparting motion thereto. It is understood that controller 140 may be implemented as any number of controllers and/or processors for suitably controlling image forming device 100 to perform, among other functions, printing operations.

Figure 2:
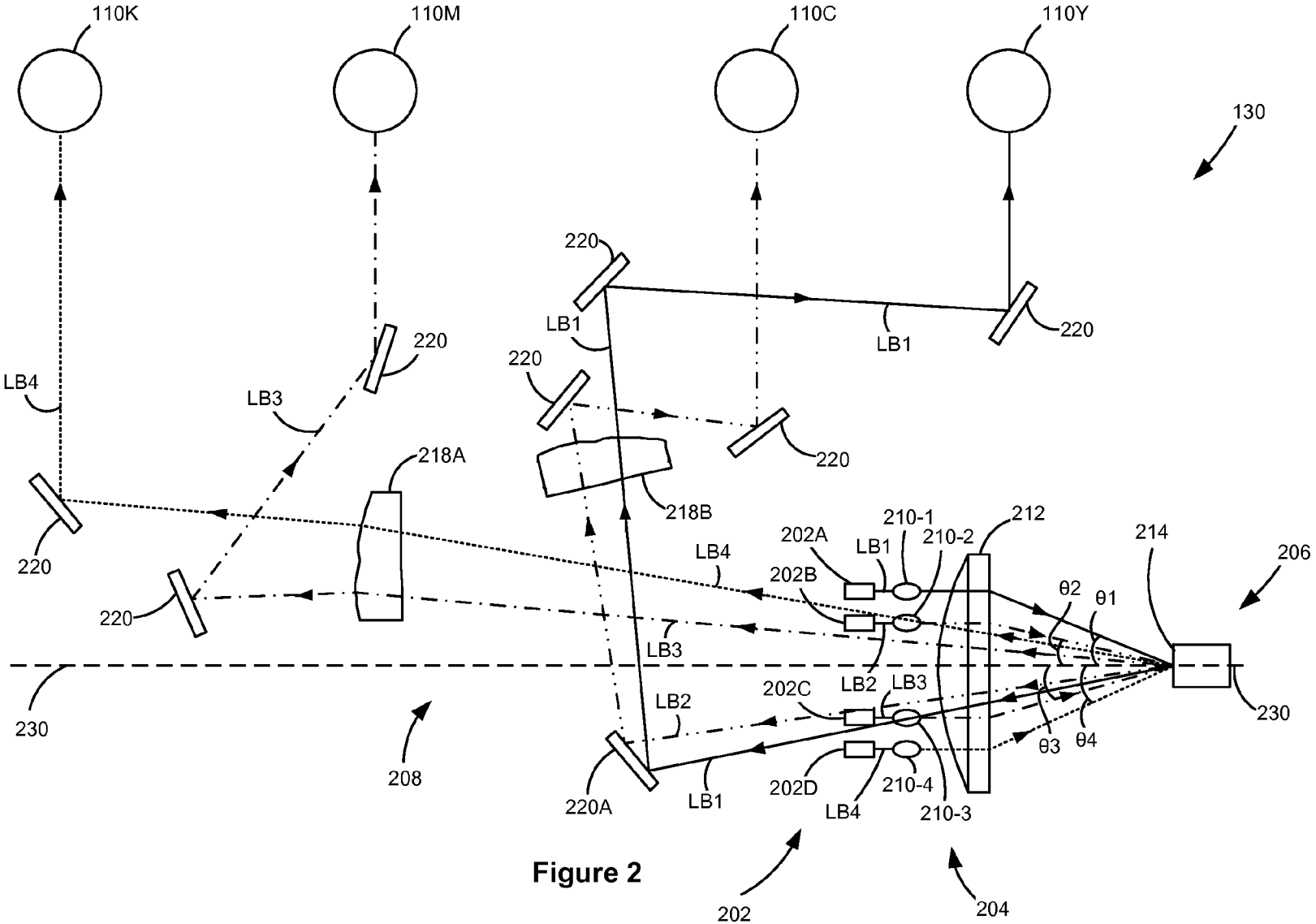
FIG. 2 illustrates an optical layout of a laser scanning unit of the imaging device in FIG. 1 according to an example embodiment.

Referring now to FIG. 2, an optical layout of LSU 130 is shown according to an example embodiment of the present disclosure. LSU 130 may include a light assembly 202, pre-scan optics 204, a scanning device 206, and post-scan optics 208.

Light assembly 202 may include light sources 202A, 202B, 202C, and 202D associated with cyan, magenta, yellow and black (CMYK) color image planes, respectively, such that each light source generates a light beam for use in forming a latent image on the surface of a corresponding photoconductive member 110. Each light source of light assembly 202 may be implemented, for example, using a laser diode or any other suitable device for generating a beam of light. LSU 130 may also include driver circuitry (not shown) communicatively coupled to controller 140 for receiving video/image information and/or control data that may be utilized to set and/or vary the laser power used by each light source of light assembly 202.

Pre-scan optics 204 may include one or more collimating lenses 210 and/or pre-scan lens 212 to direct and focus each of the modulated beams LB emitted by light sources 202A-202D towards scanning device 206. In one example, pre-scan lens 212 may be a cylinder pre-scan lens.

Scanning device 206 may include at least one reflective surface 214 for receiving and reflecting light incident thereon. In one example embodiment, scanning device 206 may comprise a scanning oscillator, such as a torsion oscillator, controlled to operate bi-directionally at a scanning frequency to create scan lines on photoconductive members 110 in both forward and reverse directions along a main scan direction. The main scan direction may refer to the direction of scanning of a laser beam by scanning device 206 across an optical component or a photoconductive member 110. With respect to LSU 130 of FIG. 2, the main scan direction may be seen to be either into or out of the sheet on which FIG. 2 appears and generally extends between longitudinal end portions of each optical component in the post-scan path of each laser beam. On the other hand, a sub-scan direction may refer to a direction perpendicular to the main scan direction. The sub-scan direction may, in some cases, correspond to a direction along the height of an optical component. In another example embodiment, scanning device 206 may include a polygon mirror having a plurality of facets and controlled to rotate at a rotational velocity during an imaging operation so as to uni-directionally scan laser beams LB emitted by light sources 202A-202D to create scan lines on photoconductive drums 110 in a forward direction.

Post-scan optics 208 may include post-scan lenses 218A, 218B and a plurality of mirrors 220 used to focus and direct each modulated beam LB to its corresponding photoconductive member 110. It is understood that components forming post-scan optics 208 may be provided within and/or as part of the LSU 130 or alternatively be provided separately therefrom, such as being directly mounted to a frame within image forming device 100 external to LSU 130.

During an imaging operation, image data corresponding to an image to be printed may be converted by controller 140 into laser modulation data. The laser modulation data may be utilized by the driver circuitry to modulate at least one of light sources 202A-202D so that LSU 130 outputs modulated laser beams LB. Each laser beam LB emitted from its corresponding light source 202 may be collimated by corresponding collimation lenses 210 and pass through pre-scan lens 212 so that the laser beams LB converge to strike the reflective surface 214 of the scanning device 206.

In FIG. 2, a reference horizontal plane 230 passes through a normal of the reflective surface 214 of the scanning device 206 from a central portion thereof, and extends into and out of the sheet. According to an example embodiment, the light sources 202A-202D may be arranged vertically offset from each other on the same side of scanning device 206. In the example layout shown, two upper light sources 202A, 202B are disposed above reference plane 230 and two lower light sources 202C, 202D are disposed below reference plane 230. After passing through pre-scan lens 212, the laser beams emitted by each of the light sources 202A-202D converge into scanning device 206. The vertically offset arrangement between the light sources allows each of the emitted laser beams LB to be incident on the reflective surface 214 of the scanning device 206 at different angles with respect to reference plane 230. In particular, laser beam LB1 emitted by light source 202A becomes incident on the reflective surface 214 from above the reference plane at an angle θ1, laser beam LB2 emitted by light source 202B becomes incident on the reflective surface 214 from above reference plane 230 at an angle θ2, laser beam LB3 emitted by light source 202C becomes incident on the reflective surface 214 from below the reference plane 230 at an angle θ3, and laser beam LB4 emitted by light source 202D becomes incident on the reflective surface 214 from below the reference plane 230 at an angle θ4. Thus, laser beams LB emitted by the light source 202 become incident on the reflective surface 214 from the same side of the scanning device 206 and at different angles with respect to the reference plane 230. In an example embodiment, the laser beams LB may strike the reflective surface 214 at overlapping reflection points. In other alternative embodiments, the laser beams LB may strike the reflective surface 214 without overlapping with each other.

As a further consequence of the vertically offset arrangement between light sources 202A-202D, laser beams LB are also reflected off of the reflective surface 214 of the scanning device 206 at different angles with respect to the reference plane 230. In the example shown, the upper channels consisting of laser beams LB1, LB2 are reflected off of the reflective surface 214 towards a direction below the reference plane 230, while the lower channels consisting of laser beams LB3, LB4 are reflected off of the reflective surface 214 towards a direction above the reference plane 230. Reflected laser beams LB3, LB4 may directly enter first scan lens 218A disposed above the reference plane 230 while reflected laser beams LB1, LB2 may be picked off by fold mirror 220A disposed below the reference plane 230. Fold mirror 220A may direct reflected laser beams LB1, LB2 toward second scan lens 218B disposed above the reference plane 230. The first and second scan lenses 218 may focus the reflected laser beams into small spot sizes on corresponding photoconductive members 110 with the aid of the plurality of mirrors 220 positioned downstream of the first and second scan lenses 218. In this example, two laser beams LB share a single scan lens 218 such that the optical system requires only two scan lenses 218, and only a single fold mirror 220A is used upstream of the scan lens 218B relative to laser beam direction.

In the example embodiment of FIG. 2, reference plane 230 is depicted as being horizontal and light sources 202A-202D are depicted as being vertically offset from each other. However, it will be appreciated that the above-described orientations have been presented for ease of description and should not be considered limiting, and that other orientations may be implemented. For example, in an alternative embodiment, light sources 202A-202D may be horizontally offset from each other, and reference plane 230 may be a vertical plane.

Figure 3B:
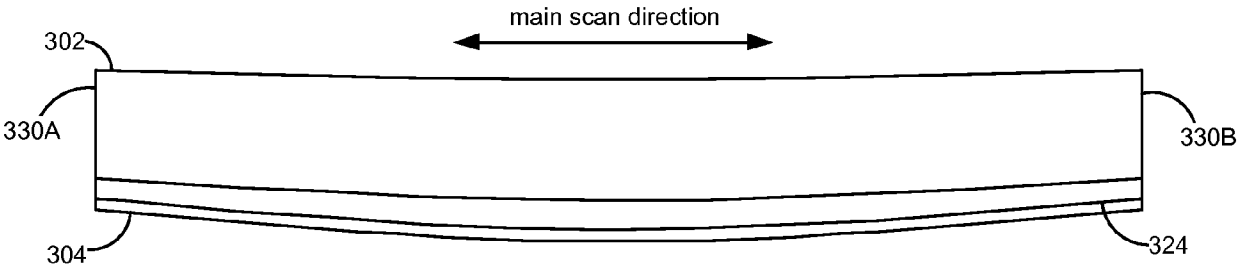
FIG. 3B illustrates a top view of the scan lens in FIG. 3A.
Figure 3C:
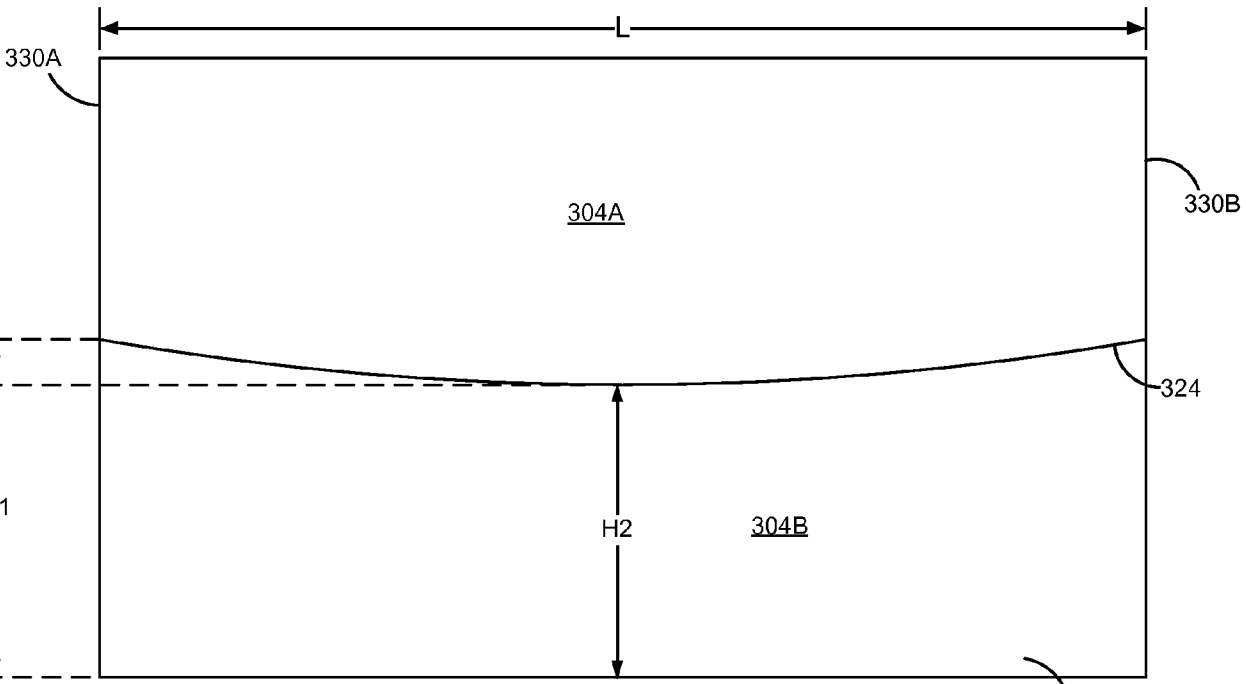
FIG. 3C illustrates a front view of the scan lens in FIG. 3A.
Figure 3A:
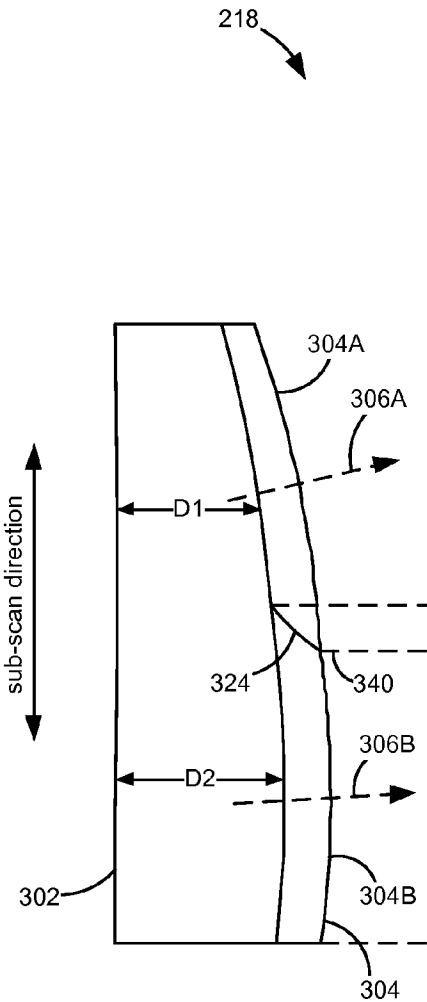
FIG. 3A illustrates a side view of a scan lens used in the laser scanning unit of FIG. 2 according to an example embodiment.
Figure 4:
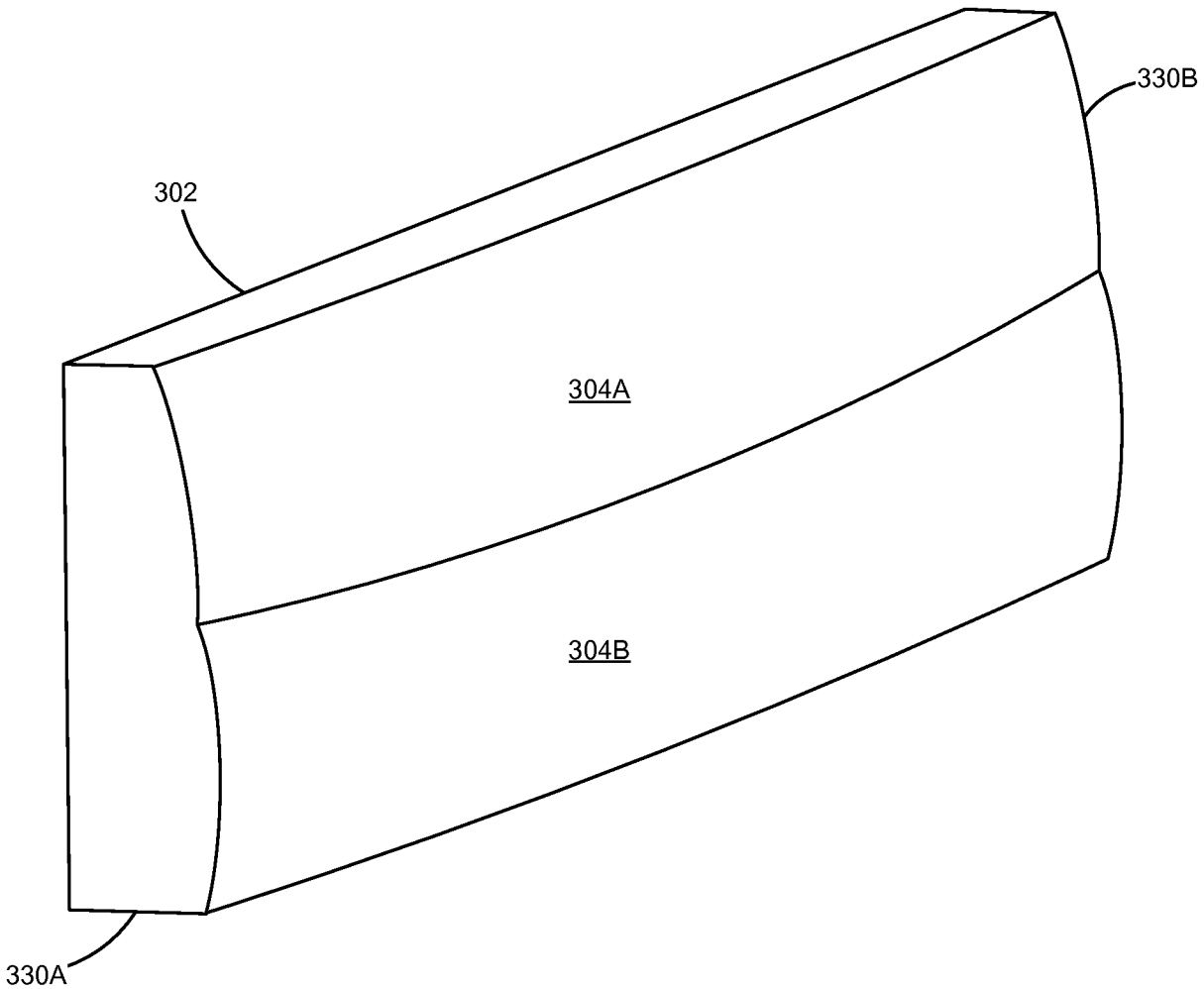
FIG. 4 illustrates a perspective view of the scan lens in FIG. 3A-3C.

FIGS. 3-4, show an example shape and profile of each of scan lenses 218 according to an example embodiment. FIGS. 3A, 3B, and 3C illustrate side, top, and front views, respectively, of each of scan lenses 218, while FIG. 4 illustrates a perspective view thereof.

As shown in FIG. 3A, scan lens 218 may include a light incident surface 302 and a light exit surface 304. The light incident surface 302 may be substantially continuous and in the example embodiment is substantially planar. The light exit surface 304, on the other hand, may be partitioned into two aspherical surfaces shown in FIGS. 3A and 4 as two curved surface sections 304A and 304B. The two curved surface sections 304A and 304B may have different surface equations which may be derived or selected based on several factors to provide desired focal lengths for each of the two lens sections, such as, for example, an index of refraction of the scan lens 218, thickness, and radius of curvatures of the light incident surface 302 and respective curved sections of light exit surface 304. In an example embodiment, the first curved surface section 304A may be defined by the surface equation:

$$z=-(9.531\times10^{-4})x^2-(2.335\times10^{-2})y^2+(1.551\times10^{-7})x^4+(4.161\times10^{-6})x^2y^2-(1.340\times10^{-11})x^6-(7.501\times10^{-10})x^4y^2;$$

while the second curved surface section 304B may be defined by the surface equation:

$$z=-(9.788\times10^{-4})x^2-(2.324\times10^{-2})y^2+(1.604\times10^{-7})x^4+(3.846\times10^{-6})x^2y^2-(1.551\times10^{-11})x^6-(4.078\times10^{-10})x^4y^2;$$

where z is the surface sag, x is along the main scan direction, and y is along the sub-scan direction, all in units of millimeters.

Figure 5:
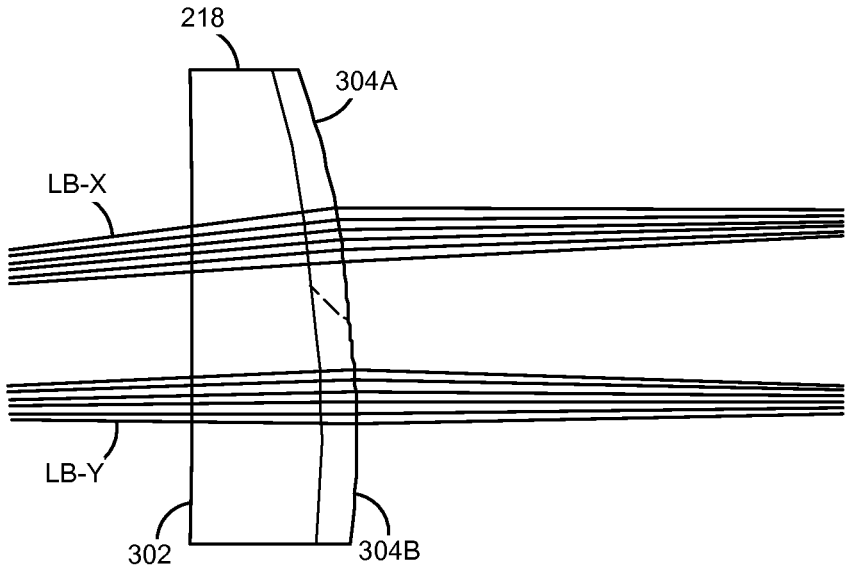
FIG. 5 illustrates two sets of ray traces through the scan lens in FIG. 3A.

The two curved surface sections 304A and 304B may further have different optical axes. For example, as shown in FIG. 3A, the first curved surface section 304A may have an optical axis indicated by arrow 306A and the second curved surface section 304B may have an optical axis indicated by arrow 306B. In FIG. 5, two sets of laser beams LB-X, LB-Y are shown entering the light incident surface 302 of scan lens 218 but exiting the scan lens 218 separately at the two curved surface sections 304A, 304B, respectively. Because the optical axes for the first curved surface section 304A and the second curved surface section 304B have different angles relative to a reference axis 340 (FIG. 3A), the two sets of laser beams LB-X, LB-Y entering the light incident surface 302 may diverge upon separately exiting the scan lens 218 at the two curved surface sections 304A and 304B, respectively. This may allow for easier separation of laser beams LB-X, LB-Y by pickoff mirrors 220 positioned downstream of the scan lenses 218.

Figure 6:
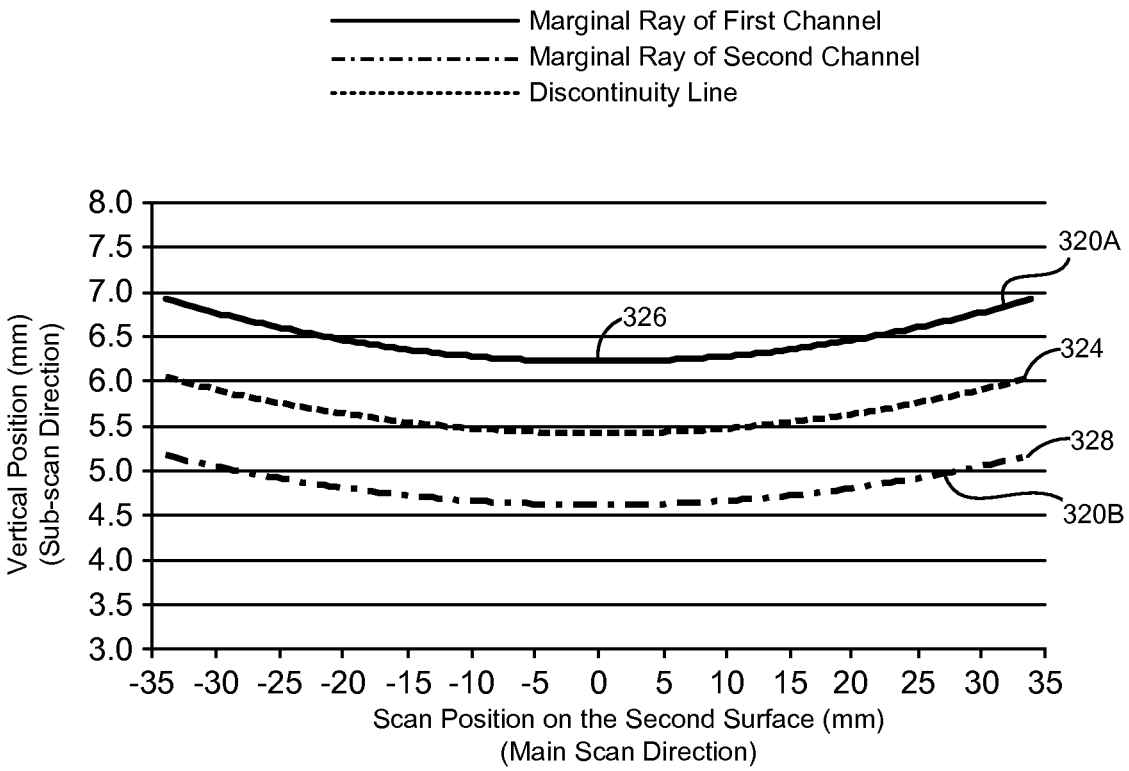
FIG. 6 is a graph showing vertical position of a discontinuity line between two curved surface sections of the scan lens of FIGS. 3A-3C relative to two light beam channels.

Since four laser beams LB1-LB4 share one reflective surface 214 of the scanning device 206 by which the beams are deflected, the optical systems involved are off-axis systems. More particularly, the upper and lower channels depicted in FIG. 2 may have a relatively large off-axis angle relative to the optical axis of the reflective surface 214. Because of this, the beam tracing on the surface of the scan lenses 218 during scanning may exhibit an optical bow. For example, as shown in FIG. 6, a first channel 320A which may correspond to a first laser beam exiting the scan lens 218 at the upper first curved surface section 304A, and a second channel 320B which may correspond to a second laser beam exiting the same scan lens 218 at the lower second curved surface section 304B, may be curved or bowed in the vertical or sub-scan direction across the main scan direction from one side portion of scan lens 218 to an opposed side portion thereof. In order to reduce cross-talk between adjacent channels or laser beams entering a common scan lens 218, a discontinuity line 324 defined by the junction formed between the first curved surface section 304A and the second curved surface section 304B of the light exit surface 304, may be bent or bowed to substantially follow the shape of the laser beams scanned across the scan lens 218. For example, the vertical position of each point of the discontinuity line 324 may lie between the first channel 320A and the second channel 320B as shown in FIG. 6. In addition, the discontinuity line 324 extending across the light exit surface 304 of the scan lens 218 may also lie between the lowest vertical ray position 326 of first channel 320A (0 mm scan position) and the highest vertical ray position 328 of second channel 320A, at which respective rays of channels 320A and 320B leave the light exit surface 304. In this way, by having a bowed discontinuity line 324 largely matching the bowed shape of light beams exiting scan lens 218 and positioned between the channels 320A and 320B for curved surface sections 304A and 304B, cross-talk between the two channels 320A and 320B may be substantially avoided.

With further reference to FIGS. 3A-3C, the discontinuity line 324 may extend across the length L of scan lens 218 between a first end 330A and a second end 330B. As shown, the discontinuity line 324 has a height that gradually decreases in a direction from the opposed longitudinal ends 330 towards a central portion between the opposed longitudinal ends 330. More particularly, the discontinuity line 324 has a height H1 at or near the first and second ends 330 that is greater than a height H2 located at or near the central portion between the first and second ends 330.

Figure 7:
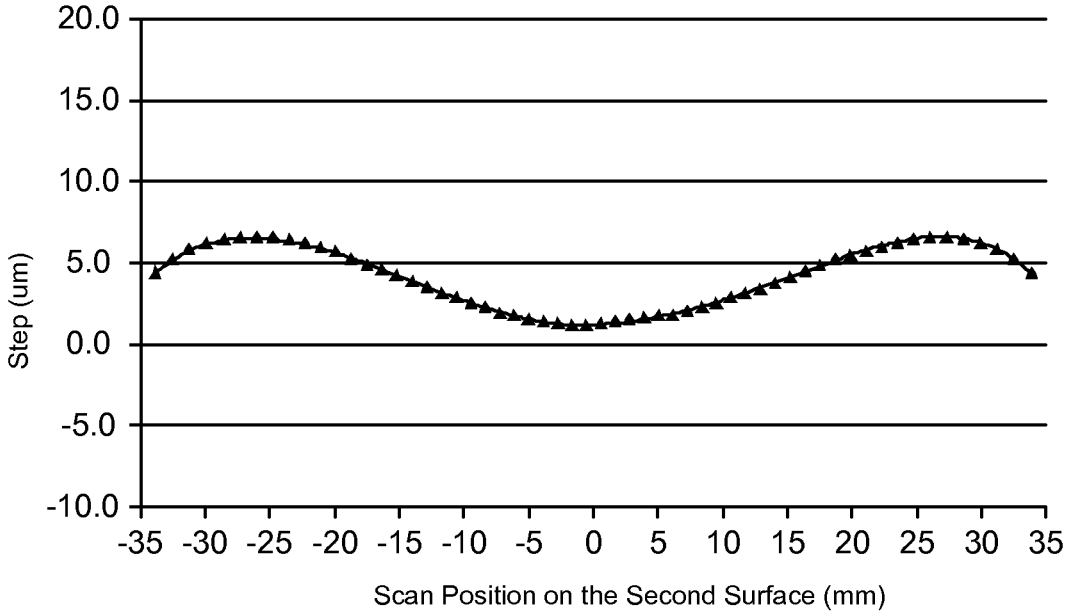
FIG. 7 is a graph illustrating step sizes of discontinuity points between the two curved surface sections associated with the discontinuity line of FIG. 6.

Each of the scan lenses 218A and 218B may be made of plastic material, such as polymethyl methacrylate (PMMA) or Zeonex resins, by injection molding. Alternatively, scan lenses 218 may be made of glass material. In some cases, a relatively large discontinuity between the two curved surface sections 304 may make it difficult to have good molding flow which may potentially increase the cooling time, hence the cost, or make the lens surfaces surrounding the discontinuity line 324 less accurate. In order to mitigate this, the discontinuity between the two curved surface sections 304A and 304B may be kept as small as possible while still meeting a desired optical performance. For example, in FIG. 3A, the thickness D1 of scan lens 218 between the light incident surface 302 and the first curved surface section 304A, the thickness D2 between the light incident surface 302 and the second curved surface section 304B, as well as the tilt angle of each curved surface section 304 relative to the reference axis 340, may be selected so that the step between the two curved surface sections 304A and 304B may be reduced to less than about 10 um. FIG. 7 shows a graph illustrating step sizes at discontinuity points between the two curved surface sections 304A and 304B according to an example embodiment. As shown, the step sizes of points of discontinuities between the two curved surface sections 304 may vary between about 0 um and about 10 um across the various scan positions of the light exit surface 304, but does not exceed 10 um.

According to an example embodiment, the overall thickness of scan lens 218 may vary between about 2 mm and about 20 mm, and more particularly between about 2 mm and 10 mm, such as about 4.5 mm. The length L (seen in FIG. 3C) of scan lens 304 across the main scan direction may be between about 50 mm and about 110 mm, and particularly between about 65 mm and about 75 mm, such as about 70 mm. Furthermore, in order for the laser beams LB to achieve a substantially uniform spot size on the photoconductive members 110 for a given amount of laser power, the arrangement of the various optical components may be in a manner such that the overall beam path lengths of the laser beams LB are substantially the same. In one example embodiment, the beam path length of a laser beam LB from reflective surface 214 of scanning device 206 to a corresponding photoconductive member 110 may be between about 180 mm and about 300 mm, and more particularly between about 200 mm and about 250 mm, such as about 204 mm. In another example embodiment, the beam path length of a laser beam LB from the reflective surface 214 of the scanning device 206 to a corresponding scan lens 218 may be between about 40 mm and about 120 mm, more particularly between about 50 mm and about 80 mm, such as about 60 mm.

By having the thickness of the scan lenses 218 relatively thin and length L thereof substantially reduced, and by having the overall beam path length of each laser beam shorter than conventional designs, as described in the above example embodiments, LSU 130 can be made more compact which may consequently reduce the volume and size of LSU 130 in the imaging apparatus. In addition, because of the compactness and simplicity of the optical layout requiring less optical components, such as requiring only two scan lenses and eight mirrors downstream the scanning device 216 in the example optical layout of FIG. 2, the above example design may reduce the tolerance stack up caused by accumulated variation of size and/or position of individual downstream optical components, and improve alignment robustness. Furthermore, the use of only two relatively thin scan lenses 218 and the decrease in the number of optical components may provide significant savings with respect to the overall cost of LSU 130, and consequently the cost of imaging apparatus 100.

The description of the details of the example embodiments have been described in the context of electrophotographic imaging devices. However, it will be appreciated that the teachings and concepts provided herein are applicable to other systems employing optical scanners for scanning light beams.

The foregoing description of several methods and an embodiment of the invention have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A scanning system for use in an imaging apparatus, comprising:

a scanning member having at least one reflective surface for reflecting light incident thereon;

a first light source, a second light source, a third light source, and a fourth light source controllable to emit first, second, third, and fourth light beams, respectively, each of the first, second, third, and fourth light beams configured to be incident on one planar surface of the at least one reflective surface of the scanning member at different angles with respect to a reference plane extending perpendicular to the planar surface such that the light beams are reflected off of the planar surface at different angles with respect to the reference plane, the first and second light beams being incident from a common side of the reference plane, and the third and fourth light beams being incident from an opposed common side of the reference plane;

a first scan lens and a second scan lens disposed downstream from the scanning member relative to optical paths of the light beams, the first scan lens for receiving and focusing the reflected first and second light beams, and the second scan lens for receiving and focusing the reflected third and fourth light beams; and a plurality of mirrors for directing the reflected and focused light beams to at least one surface;

wherein each of the first and second scan lenses has a light incident surface for receiving two of the light beams and which is substantially continuous, and a light exit surface having two curved surface sections, each curved surface section for exiting one of the light beams from the scan lens.

2. The scanning system of claim 1, further comprising a fold mirror disposed on a first side of the reference plane, wherein the first scan lens is disposed on a second side of the reference plane opposite the first side, the first and second light beams being configured to be incident on the at least one reflective surface of the scanning member from the second side of the reference plane and the fold mirror being configured to receive and direct the first and second light beams reflected by the at least one reflective surface from the first side of the reference plane toward the first scan lens located on the second side of the reference plane.

3. The scanning system of claim 1, wherein the first, second, third, and fourth light sources are disposed vertically offset from each other on a same side of the scanning member such that the respective light beams emitted by the light sources are incident on the at least one reflective surface from the same side of the scanning member.

4. The scanning system of claim 1, wherein each of the first and second scan lenses has a thickness between about 2 mm and about 20 mm.

5. The scanning system of claim 1, wherein for each first and second scan lens, a junction is formed between the two curved surface sections, the junction defining a line that is curved with respect to a sub-scan direction perpendicular to a main scan direction of the two light beams extending across the scan lens.

6. The scanning system of claim 5, wherein the curved line extends between a first end and a second end of a longitudinal length of a corresponding scan lens, the curved line having a height which is higher near the first and second ends than a location near a central portion between the first and second ends of the corresponding scan lens.

7. The scanning system of claim 5, wherein the shape of the curved line is substantially bowed.

8. The scanning system of claim 1, wherein each of the first and second scan lenses has a length from about 65 mm to about 75 mm.

9. The scanning system of claim 1, wherein a beam path length of each of the light beams from the scanning member to a corresponding scan lens is between about 40 mm and about 120 mm.

10. The scanning system of claim 1, wherein the at least one surface comprises a plurality of photoconductive surfaces, each photoconductive surface receiving thereon a distinct light beam, and a beam path length of each light beam from the scanning member to a corresponding photoconductive surface of the imaging apparatus is between about 180 mm and about 300 mm.

11. The scanning system of claim 1, wherein the scanning member includes a torsion oscillator.

12. A scanning system for use in an imaging apparatus, comprising:

a scanning member having at least one reflective surface for reflecting light incident thereon;

a first light source and a second light source to emit first and second light beams, respectively, onto the at least one reflective surface;

a scan lens for receiving and focusing the first and second light beams reflected from the at least one reflective surface, the scan lens having a light exit surface with a first curved surface section and a second curved surface section defining therebetween a junction line extending between opposed longitudinal ends of the scan lens, the junction line being bowed in a sub-scan direction perpendicular to a main scan direction extending longitudinally across the scan lens; and a plurality of mirrors for directing the focused light beams to at least one surface.

13. The scanning system of claim 12, wherein the junction line has a height that decreases from the opposed longitudinal ends of the scan lens towards a central portion between the opposed longitudinal ends.

14. The scanning system of claim 12, wherein the scan lens has a light incident surface that is substantially continuous and through which the first and second light beams enter, the first light beam exiting the scan lens at the first curved surface section thereof, and the second light beam exiting the scan lens at the second curved surface section thereof.

15. The scanning system of claim 12, further comprising third and fourth light sources to emit third and fourth light beams, respectively, onto the at least one reflective surface, wherein the first and second light beams are configured to be incident on the at least one reflective surface from a first side of a reference plane extending perpendicular to the at least one reflective surface and at different angles with respect to the reference plane, and the third and fourth light beams are configured to be incident on the at least one reflective surface from a second side of the reference plane opposite the first side and at different angles with respect to the reference plane.

16. The scanning system of claim 15, further comprising a fold mirror disposed on the second side of the reference plane for receiving the first and second light beams reflected by the at least one reflective surface, wherein the scan lens is disposed on the first side of the reference plane and the fold mirror directs the reflected first and second light beams from the second side of the reference plane toward the scan lens disposed on the first side of the reference plane.

17. The scanning system of claim 12, further comprising third and fourth light sources to emit third and fourth light beams, respectively, wherein the first, second, third, and fourth light beams are incident on the at least one reflective surface from a same side of the scanning member.

18. The scanning system of claim 12, wherein the scan lens has a thickness between about 2 mm and about 20 mm.

19. An electrophotographic imaging device, comprising:

a plurality of photoconductive members; and a scanning unit for scanning light beams across the photoconductive members so as to form a plurality of scan lines on each photoconductive member, the scanning unit including:

a scanning mirror having at least one reflective surface for reflecting light incident thereon;

a first light source, a second light source, a third light source, and a fourth light source controllable to emit first, second, third, and fourth light beams, respectively, onto the at least one reflective surface of the scanning mirror;

a first scan lens for receiving and focusing the first and second light beams reflected from the at least one reflective surface, and a second scan lens for receiving and focusing the third and fourth light beams reflected from the at least one reflective surface, each of the first and second scan lenses having a light exit surface having two curved surface sections defining therebetween a junction line extending between opposed longitudinal end portions of the scan lens, the junction line being nonlinear; and a plurality of mirrors for directing the reflected and focused light beams to corresponding photoconductive members to form images thereon;

wherein the junction line extends between a first end and a second end of a longitudinal length of a corresponding scan lens, the junction line having a height that is higher near the first and second ends than a location near a central portion between the first and second ends of the corresponding scan lens.

20. The electrophotographic imaging device of claim 19, wherein each of the first, second, third, and fourth light beams are configured to be incident on the at least one reflective surface of the scanning member at different angles with respect to a reference plane extending perpendicular to the at least one reflective surface such that the light beams are reflected off of the at least one reflective surface at different angles with respect to the reference plane.

21. A scanning system for use in an imaging apparatus, comprising:

a scanning member having at least one reflective surface for reflecting light incident thereon;

a first light source, a second light source, a third light source, and a fourth light source controllable to emit first, second, third, and fourth light beams, respectively, each of the first, second, third, and fourth light beams configured to be incident on one planar surface of the at least one reflective surface of the scanning member at different angles with respect to a reference plane extending perpendicular to the planar surface such that the light beams are reflected off of the planar surface at different angles with respect to the reference plane;

a first scan lens and a second scan lens disposed downstream from the scanning member relative to optical paths of the light beams, the first scan lens for receiving and focusing the reflected first and second light beams, and the second scan lens for receiving and focusing the reflected third and fourth light beams; and a plurality of mirrors for directing the reflected and focused light beams to at least one surface;

wherein each of the first and second scan lenses has a light incident surface for receiving two of the light beams and which is substantially continuous, and a light exit surface having two curved surface sections, each curved surface section for exiting one of the light beams from the scan lens; and wherein for each first and second scan lens, a junction is formed between the two curved surface sections, the junction defining a line that is curved with respect to a sub-scan direction perpendicular to a main scan direction of the two light beams extending across the scan lens.

22. The scanning system of claim 21, wherein the curved line extends between a first end and a second end of a longitudinal length of a corresponding scan lens, the curved line having a height which is higher near the first and second ends than a location near a central portion between the first and second ends of the corresponding scan lens.

23. The scanning system of claim 21, wherein the shape of the curved line is substantially bowed.

24. A scanning system for use in an imaging apparatus, comprising:

a scanning member having at least one reflective surface for reflecting light incident thereon;

a first light source, a second light source, a third light source, and a fourth light source controllable to emit first, second, third, and fourth light beams, respectively, each of the first, second, third, and fourth light beams configured to be incident on one planar surface of the at least one reflective surface of the scanning member at different angles with respect to a reference plane extending perpendicular to the planar surface such that the light beams are reflected off of the planar surface at different angles with respect to the reference plane, the first and second light beams being incident from a common side of the reference plane, and the third and fourth light beams being incident from an opposed common side of the reference plane;

a first scan lens and a second scan lens disposed downstream from the scanning member relative to optical paths of the light beams, the first scan lens for receiving and focusing the reflected first and second light beams, and the second scan lens for receiving and focusing the reflected third and fourth light beams;

a plurality of mirrors for directing the reflected and focused light beams to at least one surface; and a fold mirror disposed on a first side of the reference plane, wherein the first scan lens is disposed on a second side of the reference plane opposite the first side, the first and second light beams being configured to be incident on the at least one reflective surface of the scanning member from the second side of the reference plane and the fold minor being configured to receive and direct the first and second light beams reflected by the at least one reflective surface from the first side of the reference plane toward the first scan lens located on the second side of the reference plane.

* * * * *